US010436202B2

(12) United States Patent
Yamashita

(10) Patent No.: US 10,436,202 B2
(45) Date of Patent: Oct. 8, 2019

(54) SCROLL COMPRESSOR AND REFRIGERATION CYCLE APPARATUS

(71) Applicant: Mitsubishi Electric Corporation, Tokyo (JP)

(72) Inventor: Toshihiro Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 253 days.

(21) Appl. No.: 15/500,712

(22) PCT Filed: Nov. 18, 2014

(86) PCT No.: PCT/JP2014/080498

§ 371 (c)(1),
(2) Date: Jan. 31, 2017

(87) PCT Pub. No.: WO2016/079805

PCT Pub. Date: May 26, 2016

(65) Prior Publication Data

US 2017/0218957 A1 Aug. 3, 2017

(51) Int. Cl.
*F04C 15/06* (2006.01)
*F04C 29/12* (2006.01)
(Continued)

(52) U.S. Cl.
CPC ..... *F04C 29/042* (2013.01); *F04C 18/0215* (2013.01); *F04C 18/0253* (2013.01);
(Continued)

(58) Field of Classification Search
CPC .. F04C 15/06; F04C 2915/12; F04C 18/0292; F04C 29/042; F01C 1/0261; F01C 1/02
(Continued)

(56) References Cited

U.S. PATENT DOCUMENTS 5,366,352 A 11/1994 Deblois et al.
2007/0178002 A1 8/2007 Hiwata et al.
(Continued)

FOREIGN PATENT DOCUMENTS

JP S58-172403 A 10/1983
JP 59-079085 A 5/1984
(Continued)

OTHER PUBLICATIONS

Office Action dated Sep. 19, 2017 issued in corresponding JP patent application No. 2016-559723 (and English translation).
(Continued)

*Primary Examiner* — Mary Davis
*Assistant Examiner* — Deming Wan
(74) *Attorney, Agent, or Firm* — Posz Law Group, PLC

(57) ABSTRACT

A scroll compressor, includes: a pressure container; a frame including a hollow cylindrical portion and a bottom surface portion formed integrally with each other, the hollow cylindrical portion having an outer peripheral surface fixed to an inner peripheral surface of the pressure container; an orbiting scroll including a first base plate and a first spiral tooth formed on one surface of the first base plate, the orbiting scroll being rotatable in a hollow portion of the hollow cylindrical portion; a fixed scroll including a second base plate with a second spiral tooth, the second spiral tooth being meshed with the first spiral tooth; and a second suction pipe communicating with the hollow portion of the hollow cylindrical portion.

5 Claims, 6 Drawing Sheets

(51) Int. Cl.

| | |
|---|---|
| ***F01C 1/02*** | (2006.01) |
| ***F04C 18/02*** | (2006.01) |
| ***F04C 29/04*** | (2006.01) |
| ***F04C 28/28*** | (2006.01) |
| ***F04C 29/00*** | (2006.01) |
| ***F25B 1/10*** | (2006.01) |
| ***F25B 31/02*** | (2006.01) |
| ***F04C 23/00*** | (2006.01) |

(52) U.S. Cl.
CPC ..... *F04C 23/008* (2013.01); *F04C 28/28* (2013.01); *F04C 29/0085* (2013.01); *F04C 29/12* (2013.01); *F25B 1/10* (2013.01); *F25B 31/026* (2013.01); *F04C 2240/30* (2013.01); *F04C 2270/19* (2013.01)

(58) Field of Classification Search
USPC ..... 418/15, 55.1; 60/505
See application file for complete search history.

(56) References Cited

U.S. PATENT DOCUMENTS

2008/0069713 A1* 3/2008 Ignatiev ..... F04C 18/0215 418/55.3
2008/0240957 A1* 10/2008 Yanagisawa ..... F04C 18/0215 418/55.5
2010/0307173 A1* 12/2010 Guo ..... F04C 18/0253 62/84
2014/0216102 A1* 8/2014 Ignatiev ..... F25B 6/04 62/468

FOREIGN PATENT DOCUMENTS

| | | | |
|---|---|---|---|
| JP | 59-217458 | A | 12/1984 |
| JP | 02-009979 | A | 1/1990 |
| JP | 02-245490 | A | 10/1990 |
| JP | 03-202692 | A | 9/1991 |
| JP | 06-002680 | A | 1/1994 |
| JP | 06-307359 | A | 11/1994 |
| JP | H06-317270 | A | 11/1994 |
| JP | H07-253090 | A | 10/1995 |
| JP | 09-236092 | A | 9/1997 |
| JP | 2004-218536 | A | 8/2004 |
| JP | 2005-140072 | A | 6/2005 |
| JP | 2005-233095 | A | 9/2005 |
| JP | 2007-046563 | A | 2/2007 |
| JP | 2008-202526 | A | 9/2008 |
| JP | 2009-136101 | A | 6/2009 |
| JP | 2013-238142 | A | 11/2013 |

OTHER PUBLICATIONS

International Search Report of the International Searching Authority dated Feb. 24, 2015 for the corresponding International application No. PCT/JP2014/080498 (and English translation).
Office Action dated Jul. 16, 2019 issued in corresponding JP patent application No. 2016-559723 (and English translation).

* cited by examiner

SCROLL COMPRESSOR AND REFRIGERATION CYCLE APPARATUS

CROSS REFERENCE TO RELATED APPLICATION

This application is a U.S. national stage application of PCT/JP2014/080498 filed on Nov. 18, 2014, the contents of which are incorporated herein by reference.

TECHNICAL FIELD

The present invention relates to a scroll compressor and a refrigeration cycle apparatus.

BACKGROUND ART

In a related-art scroll compressor, as a unit for suppressing increase in discharge temperature, a suction injection mechanism configured to suppress increase in discharge temperature of a compressor in a manner that a part of refrigerant having flowed out of a radiator is caused to flow into a circuit on a suction side of the compressor to reduce temperature of gas to be sucked into the compressor (see Patent Literature 1) is adopted.

CITATION LIST

Patent Literature

Patent Literature 1: Japanese Unexamined Patent Application Publication No. Sho 59-217458 (top left column of page 2)

SUMMARY OF INVENTION

Technical Problem

In the suction injection mechanism of the related-art scroll compressor, a major part of the refrigerant having flowed through a suction pipe of the scroll compressor cools an electric motor and refrigerating machine oil in the scroll compressor, and then is led into a compressor unit, which is mounted in the scroll compressor and includes a fixed scroll and an orbiting scroll. That is, a part of the refrigerant sucked into the scroll compressor absorbs heat from the electric motor or the refrigerating machine oil and is increased in temperature before reaching a compression process. Thus, an effect of suppressing increase in discharge temperature is reduced. Consequently, thermal expansion of the compressor unit occurs, resulting in, for example, a tooth tip contact involving a contact between a distal end portion of a scroll tooth of the compressor unit (for example, a spiral tooth of the orbiting scroll) and an opposed base plate (for example, a base plate of the fixed scroll). Therefore, there is a problem in that an operational range of the scroll compressor (for example, a frequency of the scroll compressor) is limited.

The present invention has been made to solve the above-mentioned problem, and has an object to prevent thermal expansion of a compressor unit by suppressing increase in discharge temperature of a scroll compressor, thereby extending an operational range of the scroll compressor.

Solution to Problem

According to one embodiment of the present invention, there is provided a scroll compressor, including: a pressure container; a frame including a hollow cylindrical portion and a bottom surface portion formed integrally with each other, the hollow cylindrical portion serving as a side surface portion and having an outer peripheral surface fixed to an inner peripheral surface of the pressure container; an orbiting scroll including a first base plate and a first spiral tooth formed on one surface of the first base plate, the orbiting scroll being accommodated in a rotatable manner in a hollow portion of the hollow cylindrical portion so that the first base plate is positioned between the first spiral tooth and the bottom surface portion; a fixed scroll including a second base plate and a second spiral tooth formed on one surface of the second base plate, the fixed scroll being fixed to the frame and arranged so that the second spiral tooth is meshed with the first spiral tooth; a discharge pipe communicating with a discharge outlet formed in the first base plate; a first suction pipe communicating on an outer side of the frame with a low-pressure space inside the pressure container; and a second suction pipe extending through the pressure container and the hollow cylindrical portion to communicate with the hollow portion of the hollow cylindrical portion.

Further, according to one embodiment of the present invention, there is provided a refrigeration cycle apparatus, including: the above-mentioned scroll compressor; a radiator; a pressure reducing device; and an evaporator.

Advantageous Effects of Invention

According to one embodiment of the present invention, the second suction pipe enables sucked refrigerant to directly flow, from a refrigerant circuit constructing a refrigeration cycle, into the frame of the scroll compressor accommodating the compressor unit therein, that is, into the hollow portion of the hollow cylindrical portion of the frame. Accordingly, temperature of the refrigerant at the start of compression can be reduced, thereby being capable of suppressing increase in discharge temperature. Thermal expansion of the compressor unit can be prevented by suppressing the increase in discharge temperature of the scroll compressor. Accordingly, it is possible to extend the operational range of the scroll compressor that is limited by the thermal expansion caused by the increase in discharge temperature.

DESCRIPTION OF EMBODIMENTS

Embodiment 1

Figure 1:
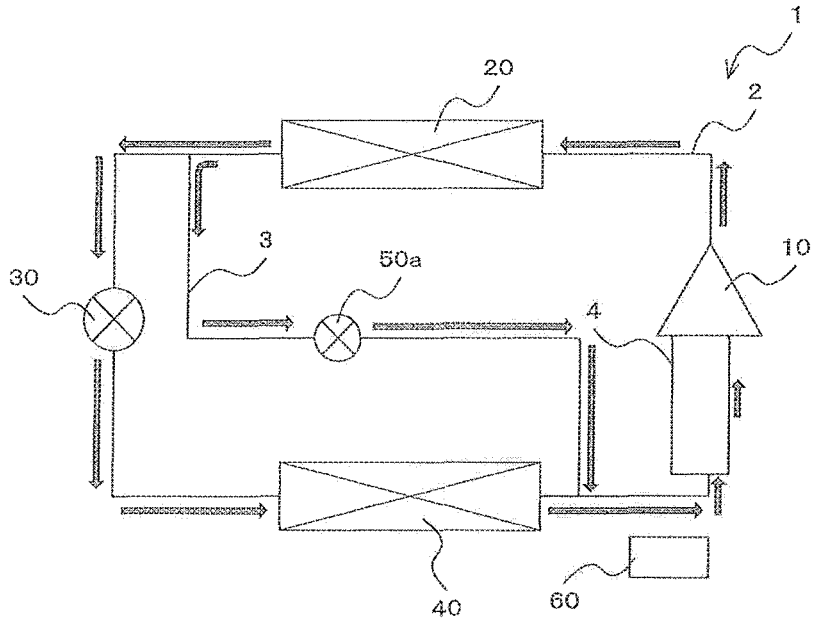
FIG. 1 is a schematic view for illustrating a configuration of a refrigeration cycle apparatus 1 according to Embodiment 1 of the present invention.

A refrigeration cycle apparatus 1 according to Embodiment 1 of the present invention is described. FIG. 1 is a schematic view for illustrating a configuration of the refrigeration cycle apparatus 1 according to Embodiment 1 of the present invention. Note that, in the following drawings including FIG. 1, dimensional relationships among components and shapes of the components may be different. Further, in the following drawings, the same or similar components or portions are denoted by the same reference symbols, or denotement by reference symbols is omitted.

The refrigeration cycle apparatus 1 according to Embodiment 1 includes a scroll compressor 10, a radiator 20, a pressure reducing device 30, and an evaporator 40. The scroll compressor 10, the radiator 20, the pressure reducing device 30, and the evaporator 40 communicate with each other through refrigerant passages, and form a refrigeration cycle 2 for circulation of refrigerant.

The scroll compressor 10 is a fluid machinery configured to compress sucked low-pressure refrigerant employing a pair of scroll laps (spiral teeth) having the same shape and discharge the sucked low-pressure refrigerant as high-pressure refrigerant. The structure and operation of the scroll compressor 10 according to Embodiment 1 of the present invention are described later.

The radiator 20 is a heat exchanger. In the radiator 20, heat is rejected from the refrigerant flowing through an inside of the radiator 20.

The pressure reducing device 30 is a device configured to decompress the high-pressure refrigerant into low-pressure refrigerant. An expansion valve, e.g., an electronic expansion valve that regulates an opening degree is used as the pressure reducing device 30.

The evaporator 40 is a heat exchanger. In the evaporator 40, the refrigerant flowing through an inside of the evaporator 40 absorbs heat from an outside of the evaporator 40.

Next, operation of the refrigeration cycle 2 in the refrigeration cycle apparatus 1 according to Embodiment 1 is described. High-temperature and high-pressure gas-phase refrigerant discharged from the scroll compressor 10 flows into the radiator 20. In the radiator 20, heat is exchanged between the refrigerant flowing through the inside of the radiator 20, and the outside of the radiator 20 (for example, outside air in a case of cooling operation of an air-conditioning apparatus), and then condensation heat of the refrigerant is rejected to the outside. In this manner, the high-temperature and high-pressure gas-phase refrigerant having flowed into the radiator 20 is changed into two-phase refrigerant and then changed into high-pressure liquid-phase refrigerant. The high-pressure liquid-phase refrigerant flows into the pressure reducing device 30, and is changed into low-pressure two-phase refrigerant through decompression. Then, the low-pressure two-phase refrigerant flows into the evaporator 40. In the evaporator 40, heat is exchanged between the refrigerant flowing through the inside of the evaporator 40, and the outside of the evaporator 40 (for example, indoor air in the case of cooling operation of the air-conditioning apparatus), and then evaporation heat of the refrigerant is absorbed from the outside. In this manner, the low-pressure two-phase refrigerant having flowed into the evaporator 40 is changed into low-pressure gas-phase refrigerant or low-pressure two-phase refrigerant having high quality. The low-pressure gas-phase refrigerant or the low-pressure two-phase refrigerant having high quality is sucked into the scroll compressor 10. The low-pressure gas-phase refrigerant sucked into the scroll compressor 10 is compressed and changed into high-temperature and high-pressure gas-phase refrigerant. The above-mentioned operation is performed in the refrigeration cycle 2.

The refrigeration cycle apparatus 1 according to Embodiment 1 includes a bypass passage 3 configured to reduce temperature of the refrigerant to be sucked into the scroll compressor 10. The bypass passage 3 connects a refrigerant passage between the radiator 20 and the pressure reducing device 30 of the refrigeration cycle 2, to a refrigerant passage between the evaporator 40 and the scroll compressor 10 of the refrigeration cycle 2. With this configuration, the bypass passage 3 allows a part of the refrigerant having flowed out of the radiator 20 to be bypassed to a refrigerant passage of the refrigeration cycle 2 on an outlet side of the evaporator 40 (that is, a refrigerant passage of the refrigeration cycle 2 on a suction side of the scroll compressor 10).

In Embodiment 1, the bypass passage 3 includes a first flow control device 50*a*. Through control of the opening degree, the first flow control device 50*a* controls a flow rate of the refrigerant flowing through the bypass passage 3.

The refrigeration cycle apparatus 1 according to Embodiment 1 includes a controller 60. The opening degree control of the first flow control device 50*a* can be executed by the controller 60. The controller 60 includes a microcomputer including a CPU, a memory (for example, a ROM or a RAM), and an I/O port.

In the refrigeration cycle apparatus 1 according to Embodiment 1, a first branched passage 4 on downstream of a junction of the bypass passage 3 and the refrigerant passage between the evaporator 40 and the scroll compressor 10 of the refrigeration cycle 2 is arranged.

Figure 2:
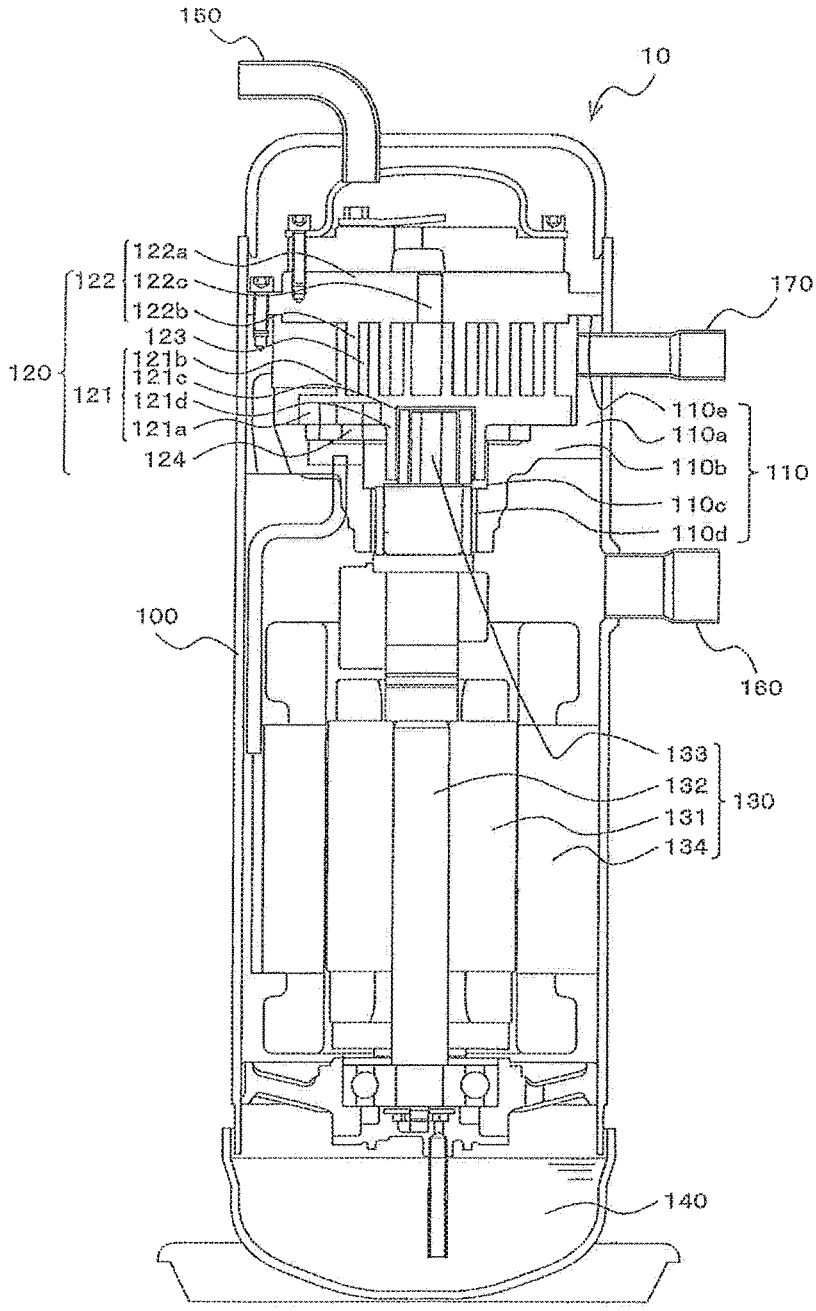
FIG. 2 is a schematic vertical sectional view for illustrating a configuration of a scroll compressor 10 according to Embodiment 1 of the present invention.

Next, a configuration of the scroll compressor 10 according to Embodiment 1 of the present invention is described. FIG. 2 is a schematic vertical sectional view for illustrating the configuration of the scroll compressor 10 according to Embodiment 1 of the present invention. In Embodiment 1 of the present invention, description is given of an example of the configuration of the scroll compressor 10 of a vertical installation type.

As described above, the scroll compressor 10 is the fluid machinery configured to compress sucked low-pressure refrigerant and discharge the sucked low-pressure refrigerant as high-pressure refrigerant. The scroll compressor 10 includes a pressure container 100 being a cylindrical casing. Inside the pressure container 100, a frame 110 is accommodated. The frame 110 includes a hollow cylindrical portion 110*a* serving as a side surface portion, and a bottom surface portion 110*b*. The hollow cylindrical portion 110*a* and the bottom surface portion 110*b* are formed integrally with each other. An outer peripheral surface of the hollow cylindrical portion 110*a* of the frame 110 is fixed to an inner peripheral surface of the pressure container 100 by welding or other methods. In the frame 110, a compressor unit 120 including an orbiting scroll 121 and a fixed scroll 122 is accommodated.

The orbiting scroll 121 includes a first base plate 121*a* and a first spiral tooth 121*b* that is a spiral protrusion formed into an involute curve shape on one surface of the first base plate 121*a*. The orbiting scroll 121 is accommodated in a rotatable manner in a hollow portion of the hollow cylindrical portion 110*a* of the frame 110 so that the first base plate 121*a* is positioned between the first spiral tooth 121*b* and the bottom surface portion 110*b* of the frame 110. In Embodiment 1, the orbiting scroll 121 is accommodated in the hollow portion of the hollow cylindrical portion 110*a* of the frame 110 so that a distal end portion of the first spiral tooth 121*b* is oriented upward.

At a center portion of an other surface of the first base plate 121*a* of the orbiting scroll 121, a boss portion 121*d* including a rotating bearing 121*c* configured to cause the orbiting scroll 121 to eccentrically rotate is formed. At a center portion of the bottom surface portion 110*b* of the frame 110, a recessed rotating support portion 110*c* in which the boss portion 121*d* of the orbiting scroll 121 is accommodated in an eccentrically rotatable manner, and a main shaft support portion 110*d* configured to support a main shaft 132 of an electric motor unit 130, which is described later, in a rotatable manner are formed.

The fixed scroll 122 includes a second base plate 122*a* and a second spiral tooth 122*b* that is a spiral protrusion formed into an involute curve shape on one surface of the second base plate 122*a*. The second spiral tooth 122*b* of the fixed scroll 122 is arranged so as to be meshed with the first spiral tooth 121*b* of the orbiting scroll 121. In Embodiment 1, the second spiral tooth 122*b* of the fixed scroll 122 is meshed with the first spiral tooth 121*b* of the orbiting scroll 121 so that a distal end portion of the second spiral tooth 122*b* is oriented downward.

The second base plate 122*a* of the fixed scroll 122 is fixed to an annular surface 110*e* of the hollow cylindrical portion 110*a* of the frame 110 by a fixing member (for example, a bolt). Further, in the fixed scroll 122 (for example, a center potion of the fixed scroll 122), a discharge outlet 122*c* through which refrigerant gas, which is compressed into high-temperature and high-pressure refrigerant gas, is discharged is formed.

As described above, the orbiting scroll 121 and the fixed scroll 122 are mounted to the frame 110 under a state in which the first spiral tooth 121*b* and the second spiral tooth 122*b* are meshed with each other. A compression chamber 123 having a relatively variable volume is defined between the first spiral tooth 121*b* and the second spiral tooth 122*b*.

The electric motor unit 130 is configured to eccentrically rotate the orbiting scroll 121, to thereby enable the compressor unit 120 to compress the refrigerant. In Embodiment 1, the electric motor unit 130 is arranged below the frame 110. The electric motor unit 130 includes a rotator 131, the main shaft 132 fixed at a center portion of the rotator 131, a rotating shaft 133 formed at a distal end portion of the main shaft 132, and a stator 134 arranged in a periphery of the rotator 131. The rotating shaft 133 is supported on the rotating bearing 121*c* of the orbiting scroll 121. The stator 134 is fixed inside the pressure container 100. In the electric motor unit 130, the stator 134 is energized, to thereby rotate the rotator 131. Along with rotation of the main shaft 132 fixed to the rotator 131, the rotating shaft 133 eccentrically rotates, and the orbiting scroll 121 eccentrically rotates.

Eccentric rotating motion of the orbiting scroll 121 is revolving motion of the orbiting scroll 121 rotating about the second spiral tooth 122*b* of the fixed scroll 122. An Oldham ring 124 is accommodated in the frame 110. The Oldham ring 124 enables the orbiting scroll 121 to make revolving motion, and inhibits the orbiting scroll 121 from making rotating motion during eccentric rotating of the orbiting scroll 121.

Refrigerating machine oil 140 for smooth operation of the compressor unit 120 is stored in a bottom portion (oil-reservoir portion) of the pressure container 100. Along with rotation of the main shaft 132, the refrigerating machine oil 140 is sucked through an oil supply passage (not shown) formed in the main shaft 132, and then supplied into the compressor unit 120.

The scroll compressor 10 according to Embodiment 1 includes a discharge pipe 150 communicating with the discharge outlet 122*c* of the fixed scroll 122. The discharge pipe 150 guides the high-temperature and high-pressure gas-phase refrigerant discharged from the scroll compressor 10 into the refrigerant passage between the scroll compressor 10 and the radiator 20 of the refrigeration cycle 2 illustrated in FIG. 1. In Embodiment 1, the discharge pipe 150 is arranged above the fixed scroll 122.

The scroll compressor 10 according to Embodiment 1 includes a first suction pipe 160 communicating on an outer side of the frame 110 with a low-pressure space inside the pressure container 100. The first suction pipe 160 communicates with the refrigerant passage between the evaporator 40 and the scroll compressor 10 of the refrigeration cycle 2 illustrated in FIG. 1, and guides the refrigerant, which flows from the evaporator 40 and the bypass passage 3, into the pressure container 100. In Embodiment 1, the first suction pipe 160 is arranged on a side surface of a barrel portion of the pressure container 100, and communicates below the frame 110 with the low-pressure space inside the pressure container 100.

The scroll compressor 10 according to Embodiment 1 includes a second suction pipe 170 extending through the pressure container 100 and the hollow cylindrical portion 110*a* of the frame 110 to communicate with the hollow portion of the hollow cylindrical portion 110*a*. The second suction pipe 170 communicates with the first branched passage 4 illustrated in FIG. 1, and directly guides, into the compressor unit 120, a part of the refrigerant having flowed from the evaporator 40 and the bypass passage 3 into the first branched passage 4.

Next, operation of the scroll compressor 10 according to Embodiment 1 is described.

When driving voltage is applied to the electric motor unit 130, the rotator 131 is rotated by a rotating force from a rotating magnetic field generated by the stator 134. Along with this, the main shaft 132 fixed to the rotator 131 is rotated. The rotation of the main shaft 132 is transmitted to the orbiting scroll 121 through the rotating shaft 133 formed at the distal end portion of the main shaft 132. The orbiting scroll 121 is inhibited by the Oldham ring 124 from making rotating motion, but makes revolving motion.

Along with rotation of the main shaft 132, the refrigerant flowing through the first suction pipe 160, and the refrigerant flowing through the second suction pipe 170 are sucked into the compression chamber 123 on an outer peripheral side defined by the orbiting scroll 121 and the fixed scroll 122. The refrigerant flowing through the first suction pipe 160 flows from the refrigerant passage between the evaporator 40 and the scroll compressor 10 of the refrigeration cycle 2 into the low-pressure space defined on the outer side of the frame 110 inside the pressure container 100. The refrigerant flowing through the second suction pipe 170 directly flows from the first branched passage 4 into the hollow cylindrical portion 110*a* of the frame 110.

The refrigerant sucked into the compression chamber 123 flows to a center portion of the compression chamber 123 while being gradually compressed due to eccentric rotating of the orbiting scroll 121. Then, the refrigerant compressed in the compression chamber 123 is changed into the high-temperature and high-pressure gas-phase refrigerant, and is discharged through the discharge outlet 122*c* formed in the second base plate 122*a* of the fixed scroll 122. The high-temperature and high-pressure gas-phase refrigerant discharged through the discharge outlet 122*c* is guided through the discharge pipe 150 into the refrigerant passage between the scroll compressor 10 and the radiator 20 of the refrigeration cycle 2.

Next, effects of the scroll compressor 10 according to Embodiment 1 are described.

In the related-art scroll compressor, refrigerant having flowed through a suction pipe (corresponding to the first suction pipe 160 according to Embodiment 1) absorbs heat generated in the low-pressure space inside the scroll compressor (for example, heat generated in the electric motor unit or the refrigerating machine oil) and is increased in temperature. Accordingly, an effect of suppressing increase in discharge temperature is reduced, with the result that an operational range of the scroll compressor is limited.

In contrast, the scroll compressor 10 according to Embodiment 1 includes the second suction pipe 170 communicating with the refrigerant passage between the evaporator 40 and the scroll compressor 10 (that is, a circuit on a suction side of the scroll compressor 10). The second suction pipe 170 is configured to cause a part of the refrigerant circulating in the refrigerant passages to directly flow into the hollow portion of the hollow cylindrical portion 110*a* of the frame 110. Accordingly, increase in temperature of the refrigerant having flowed through the first suction pipe 160 is alleviated because, at the hollow portion of the hollow cylindrical portion 110*a*, the refrigerant having flowed through the first suction pipe 160 joins the refrigerant flowing through the second suction pipe 170. Further, in the scroll compressor 10 according to Embodiment 1, a part of the refrigerant having flowed out of the radiator 20 is caused to flow to the outlet side of the evaporator 40 through the bypass passage 3. Therefore, in the scroll compressor 10 according to Embodiment 1, temperature of the refrigerant at the start of compression by the compressor unit 120 can be reduced, thereby increase in discharge temperature of the scroll compressor 10 is suppressed.

In Embodiment 1, thermal expansion of the orbiting scroll 121 and the fixed scroll 122 during operation of the scroll compressor 10 can be suppressed by suppressing the increase in discharge temperature. For example, in Embodiment 1, occurrence of the tooth tip contact involving a contact between the distal end portion of the first spiral tooth 121*b* of the orbiting scroll 121 and the second base plate 122*a* of the fixed scroll 122 due to the thermal expansion can be prevented. Therefore, in Embodiment 1, the tooth tip contact due to the thermal expansion can be prevented, thereby the scroll compressor 10 that is usable for a long period of time and increased in durability is obtained. Further, it is possible to extend the operational range of the scroll compressor 10 that is limited by the thermal expansion of the orbiting scroll 121 and the fixed scroll 122.

Further, in Embodiment 1, the thermal expansion of the orbiting scroll 121 and the fixed scroll 122 can be prevented. Thus, a gap between the orbiting scroll 121 and the fixed scroll 122 can be designed into a small gap. For example, in Embodiment 1, the gap (tooth tip gap) between the first spiral tooth 121*b* of the orbiting scroll 121 and the second base plate 122*a* of the fixed scroll 122 can be designed into a small gap. Thus, leakage of refrigerant from the tooth tip gap during a compression process can be reduced. Therefore, in Embodiment 1, the gap between the orbiting scroll 121 and the fixed scroll 122 is reduced, thereby being capable of achieving increase in performance of the scroll compressor 10 and reduction in amount of energy usage.

Further, in Embodiment 1, the sucked refrigerant can be caused to flow into the hollow portion of the hollow cylindrical portion 110*a* of the frame 110. Accordingly, increase in temperature of the orbiting scroll 121 can be suppressed. For example, in Embodiment 1, increase in temperature caused by friction between the first base plate 121*a* of the orbiting scroll 121 and the frame 110 (for example, increase in temperature caused by eccentric rotating in the vicinities of the rotating bearing 121*c* and the main shaft support portion 110*d*) can be suppressed.

Embodiment 2

Figure 3:
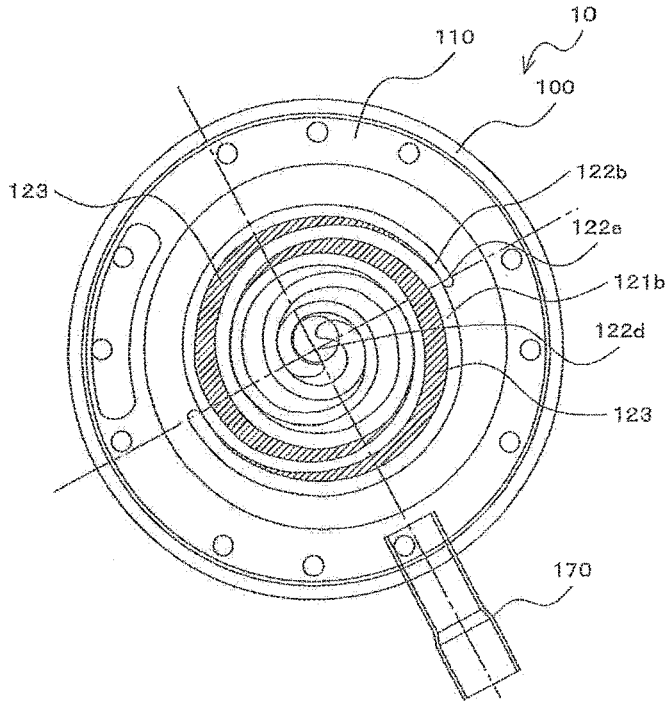
FIG. 3 is a schematic sectional view for illustrating a configuration of a compressor unit of the scroll compressor 10 according to Embodiment 2 of the present invention.

Now, the compressor unit 120 of the scroll compressor 10 according to Embodiment 2 of the present invention is described. FIG. 3 is a schematic sectional view for illustrating a configuration of the compressor unit 120 of the scroll compressor 10 according to Embodiment 2 of the present invention.

In the compressor unit 120 of the scroll compressor 10 according to Embodiment 2 of the present invention, the second suction pipe 170 is arranged so as to be orthogonal to a straight line connecting a center 122*d* of the second spiral tooth 122*b* (for example, a center of a base circle of a spiral) and a spiral tooth end 122*e* of the second spiral tooth 122*b* to each other. The other components of the scroll compressor 10 and the refrigeration cycle apparatus 1 are the same as the above-mentioned components of the scroll compressor 10 and the refrigeration cycle apparatus 1 according to Embodiment 1. Thus, description thereof is omitted.

In Embodiment 2 according to the present invention, the second suction pipe 170 is arranged so as to be orthogonal to the straight line connecting the center 122*d* and the spiral tooth end 122*e* of the second spiral tooth 122*b* to each other. Accordingly, the refrigerant having flowed through the second suction pipe can be substantially equally distributed into two paired regions of the compression chamber.

Embodiment 3

Figure 4:
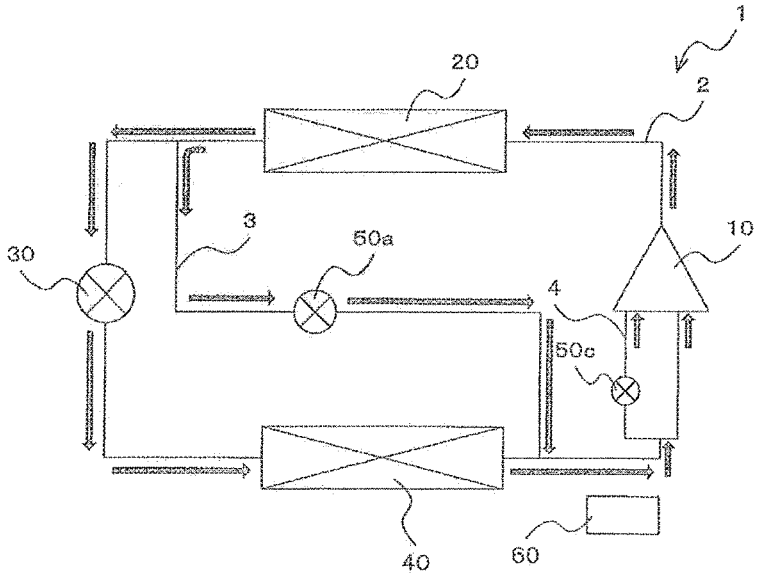
FIG. 4 is a schematic view for illustrating a configuration of the refrigeration cycle apparatus 1 according to Embodiment 3 of the present invention.
Figure 5:
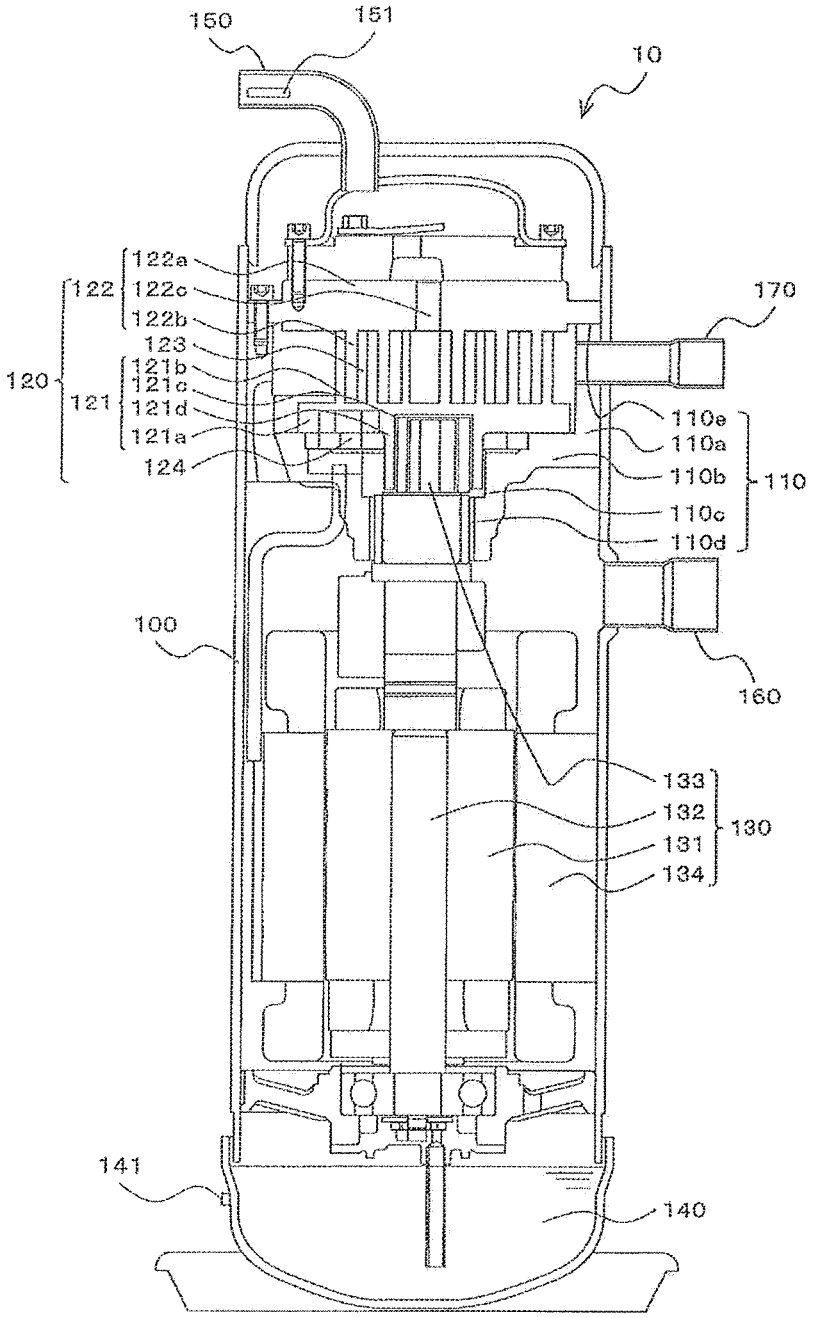
FIG. 5 is a schematic vertical sectional view for illustrating a configuration of the scroll compressor 10 according to Embodiment 3 of the present invention.

Now, the refrigeration cycle apparatus 1 and the scroll compressor 10 according to Embodiment 3 of the present invention are described. FIG. 4 is a schematic view for illustrating a configuration of the refrigeration cycle apparatus 1 according to Embodiment 3 of the present invention. FIG. 5 is a schematic vertical sectional view for illustrating a configuration of the scroll compressor 10 according to Embodiment 3 of the present invention.

In the refrigeration cycle apparatus 1 according to Embodiment 3, the bypass passage 3 includes the first flow control device 50*a*, and the first branched passage 4 includes a third flow control device 50*c*. The other components of the refrigeration cycle apparatus 1 are the same as the above-mentioned components of the refrigeration cycle apparatus 1 according to Embodiment 1. Thus, description thereof is omitted.

The scroll compressor 10 according to Embodiment 3 includes an oil temperature sensor 141 arranged at a position enabling an oil temperature of the refrigerating machine oil 140 to be assumed in order to detect the temperature (oil temperature), and includes a discharge temperature sensor 151 configured to detect temperature (discharge temperature) of the refrigerant on the discharge pipe 150 side. The other components of the scroll compressor 10 are the same as the above-mentioned components of the scroll compressor 10 according to Embodiment 1. Thus, description thereof is omitted.

The controller 60 according to Embodiment 3 is configured to receive electric signals sent from the oil temperature sensor 141 and the discharge temperature sensor 151 and control an opening degree of the third flow control device 50*c* in response to the received signals.

In Embodiment 3, the oil temperature sensor 141 is arranged on an outer side of the pressure container 100. Further, the discharge temperature sensor 151 is arranged inside the discharge pipe 150. The oil temperature sensor 141 and the discharge temperature sensor 151 are each constructed employing a thermocouple, a resistance temperature detector (for example, a thermistor), or other components.

In Embodiment 3, the controller 60 controls the opening degree of the third flow control device 50*c* through detection of the oil temperature and the discharge temperature with the oil temperature sensor 141 and the discharge temperature sensor 151, thereby a flow rate of the refrigerant flowing into the second suction pipe 170 is controlled.

The controller 60 determines whether or not the operational range of the scroll compressor 10 (for example, a frequency of the scroll compressor 10) is limited by increase in oil temperature. When it is determined that the operational range is limited, the controller 60 controls the opening degree of the third flow control device 50*c* to reduce a flow rate of the refrigerant flowing into the second suction pipe 170. In this manner, a flow rate of the refrigerant flowing into the first suction pipe 160 is increased, thereby cooling of the low-pressure space inside the scroll compressor 10 (for example, the electric motor unit 130 and the refrigerating machine oil 140) is accelerated.

Further, the controller 60 determines whether or not the operational range of the scroll compressor 10 is limited by increase in discharge temperature. When it is determined that the operational range is limited, the controller 60 controls the opening degree of the third flow control device 50*c* to increase a flow rate of the refrigerant flowing into the second suction pipe 170. In this manner, the temperature of the refrigerant at the start of compression by the compressor unit 120 can be reduced, thereby increase in discharge temperature of the scroll compressor 10 is suppressed.

Embodiment 4

Figure 6:
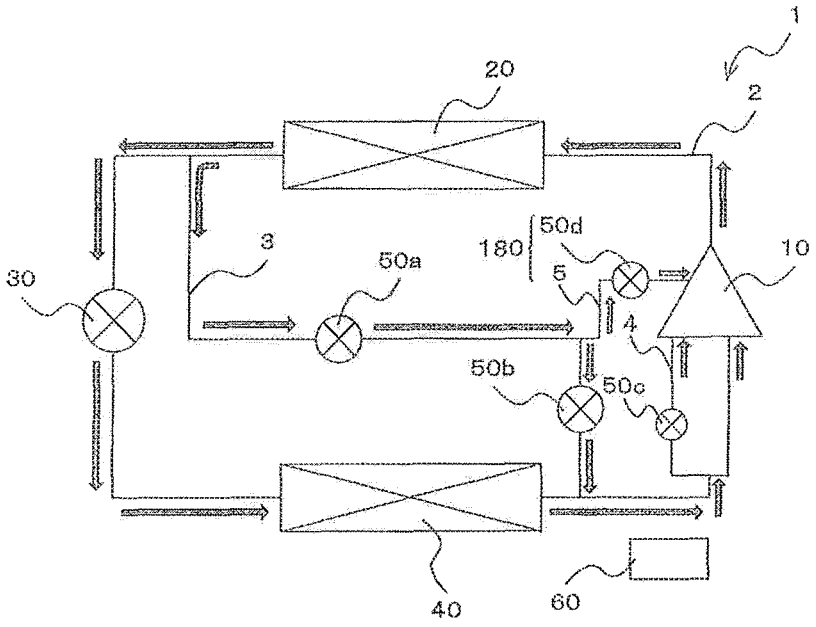
FIG. 6 is a schematic view for illustrating a configuration of the refrigeration cycle apparatus 1 according to Embodiment 4 of the present invention.
Figure 7:
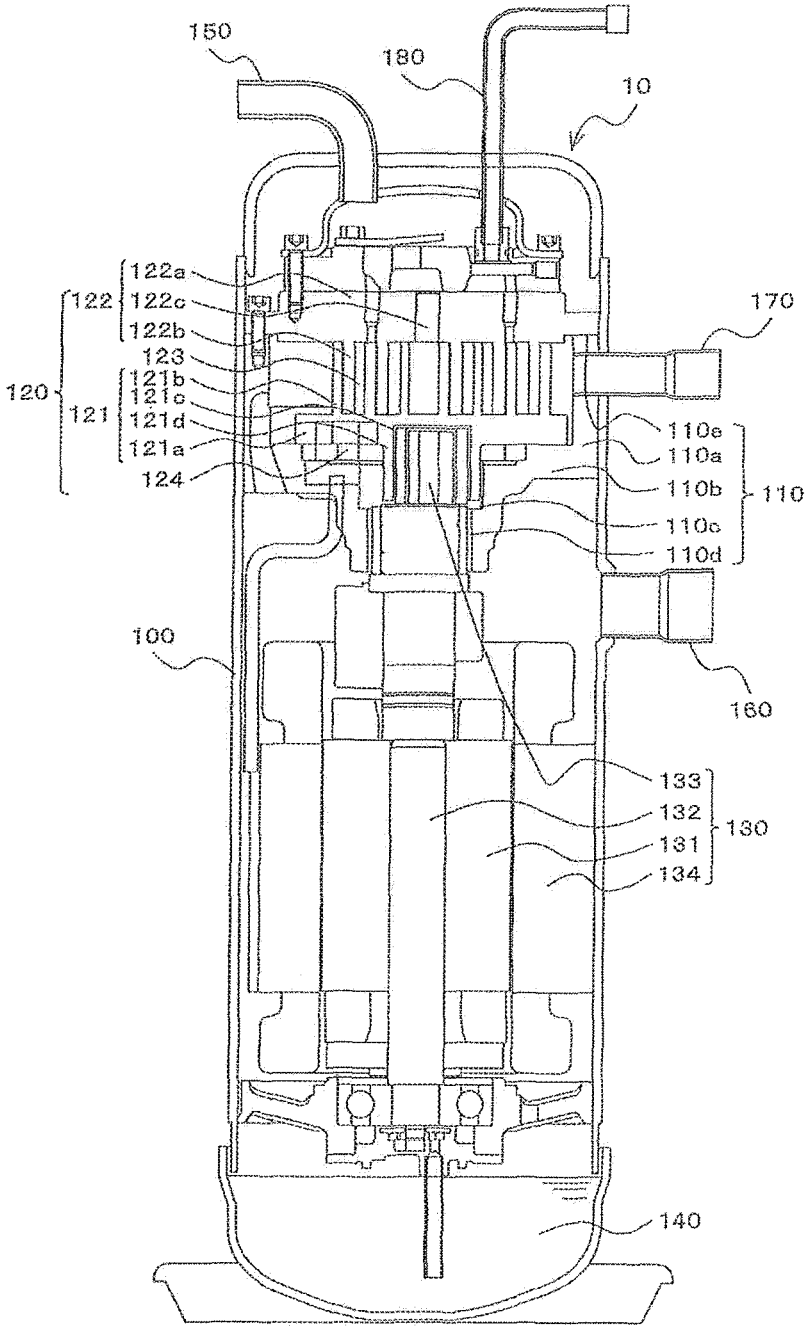
FIG. 7 is a schematic vertical sectional view for illustrating a configuration of the scroll compressor 10 according to Embodiment 4 of the present invention.

Now, the refrigeration cycle apparatus 1 and the scroll compressor 10 according to Embodiment 4 of the present invention are described. FIG. 6 is a schematic view for illustrating a configuration of the refrigeration cycle apparatus 1 according to Embodiment 4 of the present invention. FIG. 7 is a schematic vertical sectional view for illustrating a configuration of the scroll compressor 10 according to Embodiment 4 of the present invention.

The refrigeration cycle apparatus 1 according to Embodiment 4 includes a second branched passage 5 branching off from a portion of the bypass passage 3 between the first flow control device 50*a* and a second flow control device 50*b* to communicate with an intermediate-pressure region of the scroll compressor 10. Further, in the refrigeration cycle apparatus 1 according to Embodiment 4, the first branched passage 4 includes the third flow control device 50*c*, and the second branched passage 5 includes a fourth flow control device 50*d*. The other components of the refrigeration cycle apparatus 1 are the same as the above-mentioned components of the refrigeration cycle apparatus 1 according to Embodiment 1. Thus, description thereof is omitted.

The scroll compressor 10 according to Embodiment 4 includes an intermediate injection mechanism 180 communicating with the second branched passage 5 and being configured to inject the refrigerant into the compression chamber 123 in a course of the compression process. The other components of the scroll compressor 10 are the same as the above-mentioned components of the scroll compressor 10 according to Embodiment 1. Thus, description thereof is omitted.

The controller 60 according to Embodiment 4 is configured to control an opening degree of the fourth flow control device 50*d*.

The scroll compressor 10 according to Embodiment 4 can further suppress increase in discharge temperature through injection of the refrigerant by the intermediate injection mechanism 180 into the scroll compressor 10.

Another Embodiment

The present invention is not limited to the above-mentioned embodiments, and various modifications may be made thereto. For example, in the above-mentioned embodiments, the scroll compressor 10 of a vertical installation type is adopted as the scroll compressor 10, but the present invention is not limited thereto. A scroll compressor of a horizontal installation type may be adopted.

Further, the scroll compressor 10 according to the above-mentioned embodiments may be used in refrigeration cycle apparatus (heat pump apparatus) for a refrigerator, a freezer, a vending machine, an air conditioner (air-conditioning apparatus), a refrigerating apparatus (refrigerating machine), a water heater, and other machines.

Further, the refrigeration cycle apparatus 1 according to the above-mentioned embodiments may include a component other than the components described in the above-mentioned embodiments. For example, when the refrigeration cycle apparatus 1 according to the above-mentioned embodiments is an air-conditioning apparatus and performs cooling operation and heating operation, a refrigerant flow switching device (for example, a four-way valve) may be arranged on the refrigeration cycle 2.

Further, in the above-mentioned embodiments, the controller 60 may be configured to detect temperature (for example, discharge temperature) to be detected in the scroll compressor 10 and control an opening degree of the first flow control device 50*a*, the second flow control device 50*b*, or the fourth flow control device 50*d*.

Further, in Embodiment 3 described above, an other flow control device (not shown) may be arranged so as to enable control of a flow rate in the first suction pipe 160 of the scroll compressor 10, and the controller 60 may control an opening degree of the flow control device.

Further, in Embodiment 3 described above, the controller 60 may be configured to detect of temperature of the electric motor unit 130 to control an opening degree of the third flow control device 50*c*.

Further, the above-mentioned embodiments and modifications may be combined with each other for carrying out the present invention.

REFERENCE SIGNS LIST

1 refrigeration cycle apparatus 2 refrigeration cycle 3 bypass passage 4 first branched passage 5 second branched passage 10 scroll compressor 20 radiator 30 pressure reducing device 40 evaporator 50*a* first flow control device 50*b* second flow control device 50*c* third flow control device 50*d* fourth flow control device 60 controller 100 pressure container 110 frame 110*a* hollow cylindrical portion 110*b* bottom surface portion 110*c* rotating support portion 110*d* main shaft support portion 110*e* annular surface 120 compressor unit 121 orbiting scroll 121*a* first base plate 121*b* first spiral tooth 121*c* rotating bearing 121*d* boss portion 122 fixed scroll 122*a* second base plate 122*b* second spiral tooth 122*c* discharge outlet 122*d* center of second spiral tooth 122*e* spiral tooth end of second spiral tooth 123 compression chamber 130 electric motor unit 131 rotator 132 main shaft 133 rotating shaft 134 stator 140 refrigerating machine oil 141 oil temperature sensor 150 discharge pipe 151 discharge temperature sensor 160 first suction pipe 170 second suction pipe 180 intermediate injection mechanism

The invention claimed is:

1. A scroll compressor comprising:

a pressure container;

a frame comprising a hollow cylindrical portion and a bottom surface portion formed integrally with each other, the hollow cylindrical portion serving as a side surface portion and having an outer peripheral surface fixed to an inner peripheral surface of the pressure container;

an orbiting scroll comprising a first base plate and a first spiral tooth formed on one surface of the first base plate, the orbiting scroll being accommodated in a rotatable manner in a hollow portion of the hollow cylindrical portion so that the first base plate is positioned between the first spiral tooth and the bottom surface portion;

a fixed scroll comprising a second base plate and a second spiral tooth formed on one surface of the second base plate, the fixed scroll being fixed to the frame and arranged so that the second spiral tooth is meshed with the first spiral tooth;

an electric motor unit configured to eccentrically rotate the orbiting scroll;

a discharge pipe communicating with a discharge outlet formed in the second base plate;

a first suction pipe arranged between the frame and the electric motor unit, and communicating on an outer side of the frame with a low-pressure space inside the pressure container and the hollow portion of the hollow cylindrical portion; and a second suction pipe extending through the pressure container and the hollow cylindrical portion, and communicating with the hollow portion of the hollow cylindrical portion.

2. The scroll compressor of claim 1, wherein the second suction pipe is arranged so as to be orthogonal to a straight line connecting a center of the second spiral tooth and a spiral tooth end of the second spiral tooth.

3. The scroll compressor of claim 1, further comprising an intermediate injection mechanism including a pipe configured to perform, in a course of a compression process, injection into a compression chamber defined between the orbiting scroll and the fixed scroll.

4. The scroll compressor of claim 1, further comprising:

a discharge temperature sensor configured to detect temperature of refrigerant on the discharge pipe side; and an oil temperature sensor configured to detect temperature of refrigerating machine oil stored in a bottom portion of the pressure container.

5. A refrigeration cycle apparatus, comprising:

the scroll compressor of claim 1;

a radiator;

a pressure reducing device; and an evaporator.

* * * * *